US006269908B1

(12) United States Patent
Yeamans et al.

(10) Patent No.: US 6,269,908 B1
(45) Date of Patent: Aug. 7, 2001

(54) EXTENDIBLE SELF-RETRACTING LADDER

(76) Inventors: David R. Yeamans; Bwnjamin J. Yeamans, both of 392 Navajo, Los Alamos, NM (US) 87544

( * ) Notice: Subject to any disclaimer, the term of this patent is extended or adjusted under 35 U.S.C. 154(b) by 0 days.

(21) Appl. No.: 09/500,933

(22) Filed: Jan. 15, 2000

(51) Int. Cl.[7] ..... E06C 1/52
(52) U.S. Cl. ..... 182/196
(58) Field of Search ..... 182/196, 197, 182/198, 199, 70; 242/342, 379.1, 388.91, 904

(56) References Cited

U.S. PATENT DOCUMENTS

| | | | | |
|---|---|---|---|---|
| 2,985,254 | * | 5/1961 | Marryatt | 182/198 |
| 3,003,453 | * | 10/1961 | Jamieson | 242/904 X |
| 3,033,310 | * | 5/1962 | Mc Leod | 182/196 |
| 3,128,843 | * | 4/1964 | Anagnostou | 182/198 |
| 3,195,831 | * | 7/1965 | Shriner et al. | 242/904 X |
| 3,762,501 | * | 10/1973 | Probets | 182/198 X |
| 4,960,065 | * | 10/1990 | Junkeris | 242/904 X |
| 4,969,610 | * | 11/1990 | Taylor et al. | 242/904 X |
| 5,499,692 | * | 3/1996 | Brook | 182/196 |
| 5,746,287 | * | 5/1998 | Durham, Jr. | 182/196 X |
| 5,842,539 | * | 12/1998 | Hough | 182/196 X |

* cited by examiner

*Primary Examiner*—Daniel P. Stodola
*Assistant Examiner*—Hugh B. Thompson

(57) ABSTRACT

An extendible, self-retracting ladder particularly suitable for use with inflatable white water rafts and other watercraft. The ladder includes one or more rung assemblies which include tubular rungs supported by rope stiles. The rope stiles extend into the ends of the tubular rungs and are engaged with a tensioning mechanism that utilizes a pair of shock cords to apply continuous tension to the rope stiles. In the absence of weight on the ladder, the shock cord tensioning mechanisms retract the rope stiles into the tubular rungs and thereby raise the rungs into a compact retracted assembly. When a person's weight is applied to the rungs, the rope stiles are drawn out of the rungs and the rungs are extended downwardly into a conventional ladder configuration. The ladder can be stowed above the waterline when not in use, yet can be deployed and used by a person in the water without requiring any assistance from other persons aboard the watercraft.

13 Claims, 6 Drawing Sheets

EXTENDIBLE SELF-RETRACTING LADDER

BACKGROUND OF THE INVENTION

The invention disclosed and claimed herein is generally related to ladders. In particular, the present invention is related to portable ladders for use with inflatable rafts and other small watercraft.

Portable ladders used in connection with small watercraft must be capable of being lowered over the side of the watercraft to a depth beneath the surface of the water that is sufficient to permit their use by a person in the water who wishes to climb into the watercraft. However, if the ladder extends beneath the surface of the water to any significant depth, the ladder is subject to displacement whenever the watercraft is moving through the water, posing problems for the ladder, the watercraft, or both.

Rigid ladders must be either secured to the side of the watercraft or pulled aboard when the watercraft is underway, if damage to the ladder or the watercraft is to be avoided. Either alternative poses disadvantages. If the ladder is secured to the side of the watercraft it is subject to damage by impact with docks or objects in the water. If it is stowed aboard the watercraft, it is not automatically available to a person in the water without assistance, and can be awkward or even impractical to deploy quickly in an emergency.

Simple rope ladders are flexible and thus are not normally damaged as a consequence of motion through the water, nor do they tend to damage the watercraft. However, they tend to twist and become fouled if left overboard while the watercraft is underway and are thus not always immediately available to a person in the water.

White water river rafts pose additional and unique problems. They are subject to violent motion in all directions while in the water, as well as occasional collisions with rocks and other objects. Nevertheless, it is desirable to be able to quickly deploy a ladder overboard when necessary to retrieve a person who has fallen overboard. In white water situations rigid ladders are impractical and even dangerous, and ordinary rope ladders suffer from twisting and fouling, as already noted, and pose the additional danger of entanglement with a person in the water.

Accordingly, it is the object and purpose of the present invention to provide an extendible, self-retracting ladder.

It is a particular object and purpose of the present invention to provide a flexible yet retractable ladder for use with small watercraft such as rafts.

It is yet another object of the present invention to provide a retractable ladder which can be made readily available and immediately extended and deployed overboard when desired, yet which does not interfere with the operation of the watercraft.

It is yet another object of the present invention to provide a retractable ladder which is flexible and can withstand violent water motion, yet which is resistant to twisting or fouling.

Finally, it is an object of the present invention to provide a flexible ladder which can be stowed above the waterline on a watercraft, and yet which can be deployed and used in an emergency by a person in the water without requiring assistance from other persons aboard the watercraft.

These and other objects and purposes are attained in the present invention as described below and defined in the appended claims.

SUMMARY OF THE INVENTION

The present invention provides an extendible, self-retracting ladder having at least one retractable rung assembly. The retractable rung assembly includes a tubular rung and a pair of retractable rope stiles which extend into the rung at each end. The rung assembly further includes internal tensioning mechanisms mounted within the tubular rung and which are connected respectively to the pair of rope stiles. The tensioning mechanisms function to maintain sufficient tensile force on the rope stiles to withdraw the stiles into the rung and raise the rung when the ladder is not in use. When weight is applied to the rung, the stiles are drawn out of the rung and the rung is thereby extended downwardly to deploy the rung in a useful position. Where multiple rung assemblies are connected in sequence, all of the rung assemblies self-retract in the absence of weight to form a compact assembly with the rungs abutting one another. When weight is applied, all of the stiles deploy to selected lengths to space the rungs as appropriate for use as a ladder.

The tensioning mechanism in each rung assembly preferably includes a pair of axle assemblies journalled within and transversely to the tubular rung at each end of the rung, with the axle assemblies each including a pulley around which the respective rope stile passes inwardly into the tubular rung. Tension is preferably applied to the rope stiles by a pair of shock cords located in each rung, which are connected to the rope stiles and which are anchored at their opposite ends to the axle assemblies.

In accordance with another aspect of the invention, the axle assemblies may include multiple shock cord pulleys, around which the shock cords extend, in order to extend the lengths of the shock cords and thereby obtain a tensile force applied to the rope stiles which is relatively constant and which is relatively independent of the position of the rung.

These and other aspects of the present invention will be apparent from the more detailed description of the invention set forth below, when taken with the accompanying drawings and the appended claims.

BRIEF DESCRIPTION OF THE DRAWINGS

The accompanying drawings are incorporated into and form a part of this specification. In the drawings.

DETAILED DESCRIPTION OF THE INVENTION

Figure 1:
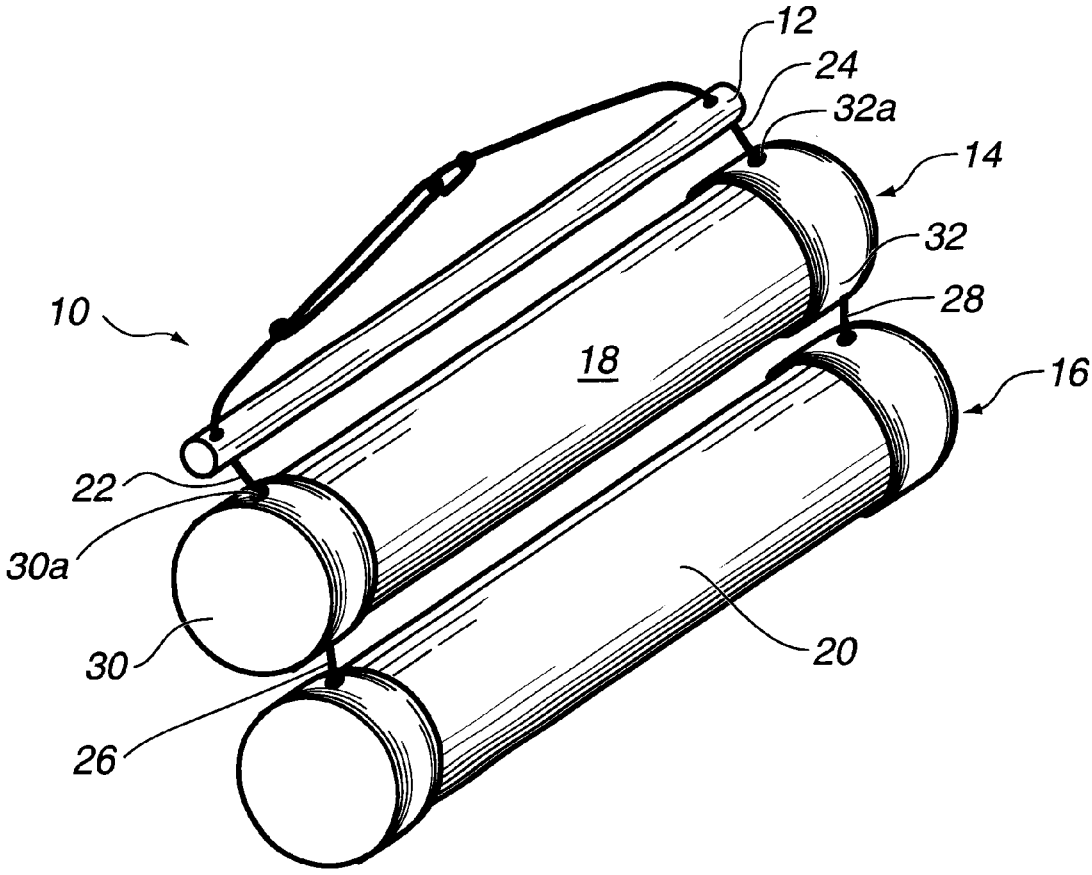
FIG. 1 is an isometric view of a preferred embodiment of an extendible, self-retracting ladder constructed in accordance with the present invention and shown in its retracted position.
Figure 2:
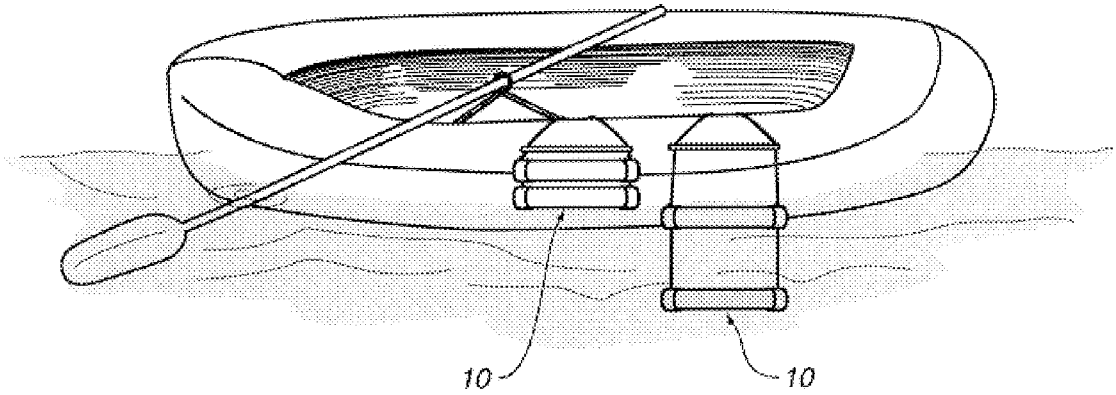
FIG. 2 shows two ladders of the kind shown in FIG. 1, as deployed on a river raft in both the retracted and extended positions.
Figure 3:
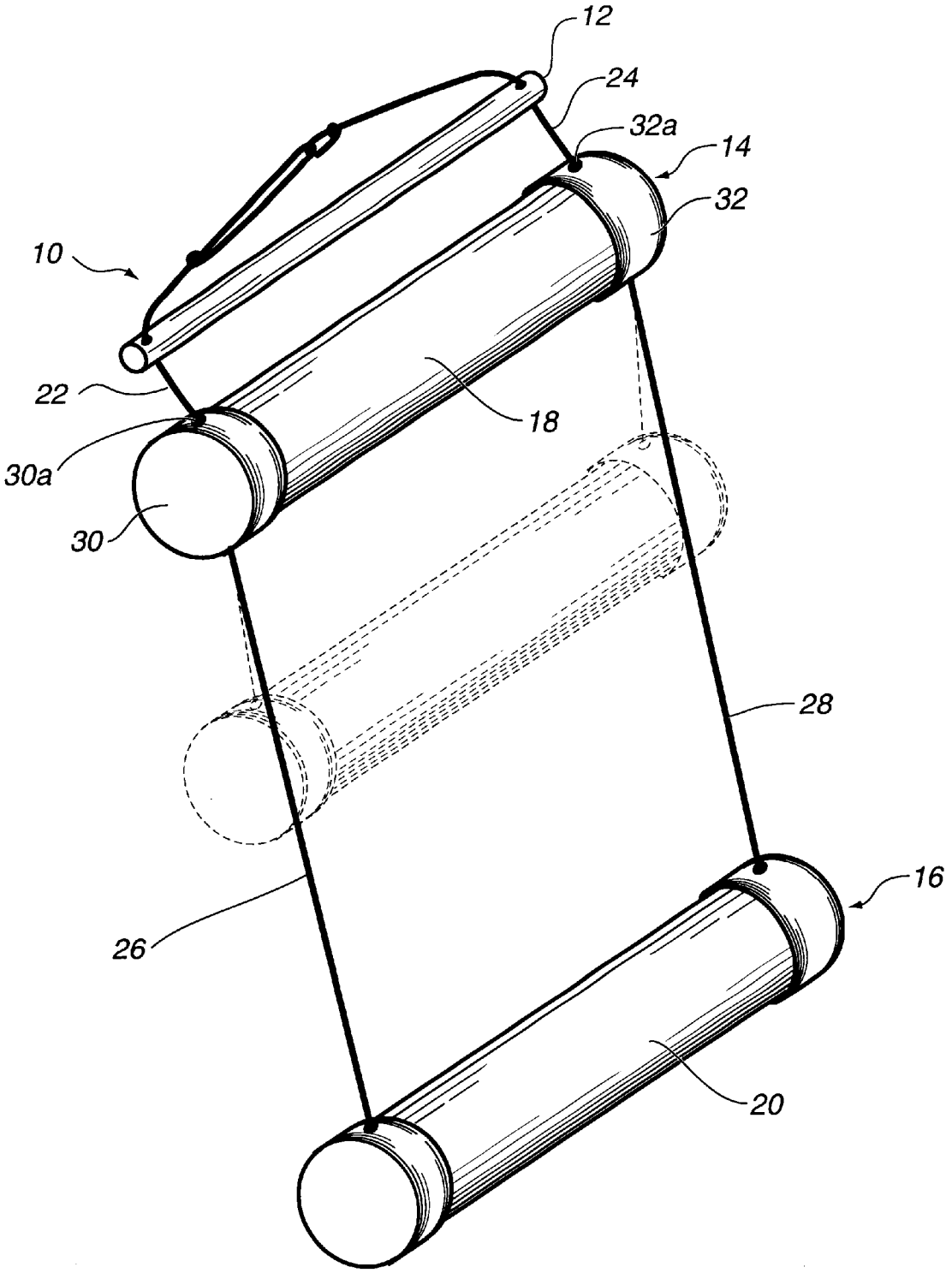
FIG. 3 is an isometric view of the ladder of FIG. 1, with the two rung assemblies extended, and including a phantom outline of the rung assemblies in their retracted positions.

Referring to FIGS. 1 through 3, a preferred embodiment of the present invention is presented in the form of an extendible, self-retracting ladder 10 which includes a rigid top cross member 12, beneath which is suspended two extendible rung assemblies 14 and 16.

The rung assemblies 14 and 16 are substantially identical, including tubular rungs 18 and 20, respectively; and pairs of left and right retractable rope stiles 22 and 24, and 26 and 28, respectively, which are maintained in a state of tension by elastomeric tensioning mechanisms contained in the rungs 18 and 20, described further below. Briefly, when the ladder 10 is not in use the rope stiles 22 through 28 are withdrawn into the tubular rungs 18 and 20, such that the rungs 18 and 20 are drawn up close to one another in a compact retracted arrangement, as shown best in FIG. 1. When a person pulls down on the rungs 18 and 20 in order to use the ladder 10, the weight of the person causes the rope stiles 22 through 28 to be drawn out of the rungs until the rungs are spaced as appropriate for ordinary use as a ladder. FIG. 3 illustrates the rung assemblies 14 and 16 in their extended positions, with their retracted positions shown in phantom outline. FIG. 2 shows a pair of ladders, illustrated for purposes of explanation with one in the retracted position and one in the extended position.

As noted above, the rung assemblies 14 and 16 are functionally identical, and thus for simplicity will be further described by reference to rung assembly 14.

Figure 4:
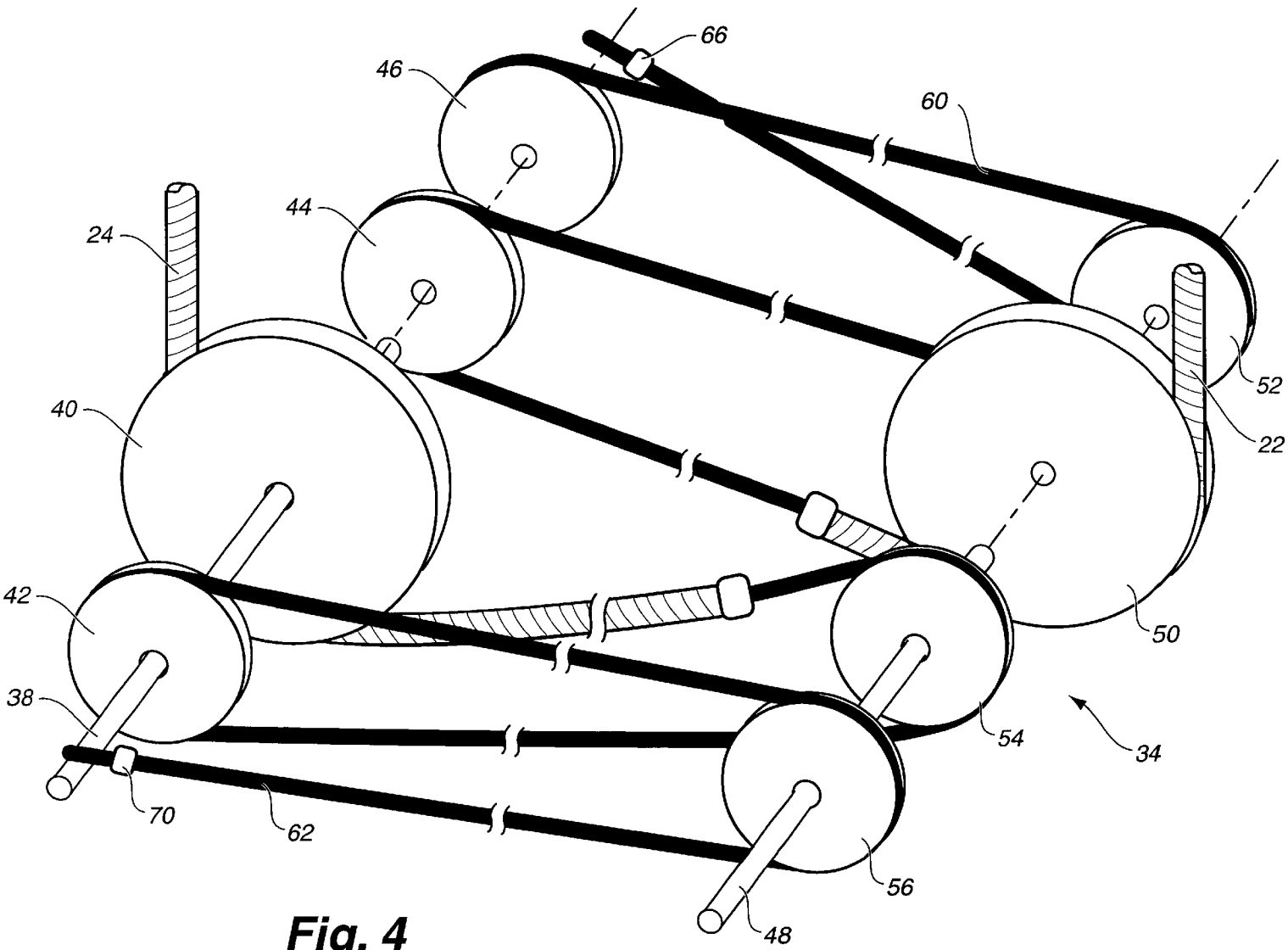
FIG. 4 is an expanded isometric schematic view of the stile retraction mechanisms that are located in each tubular rung.
Figure 5:
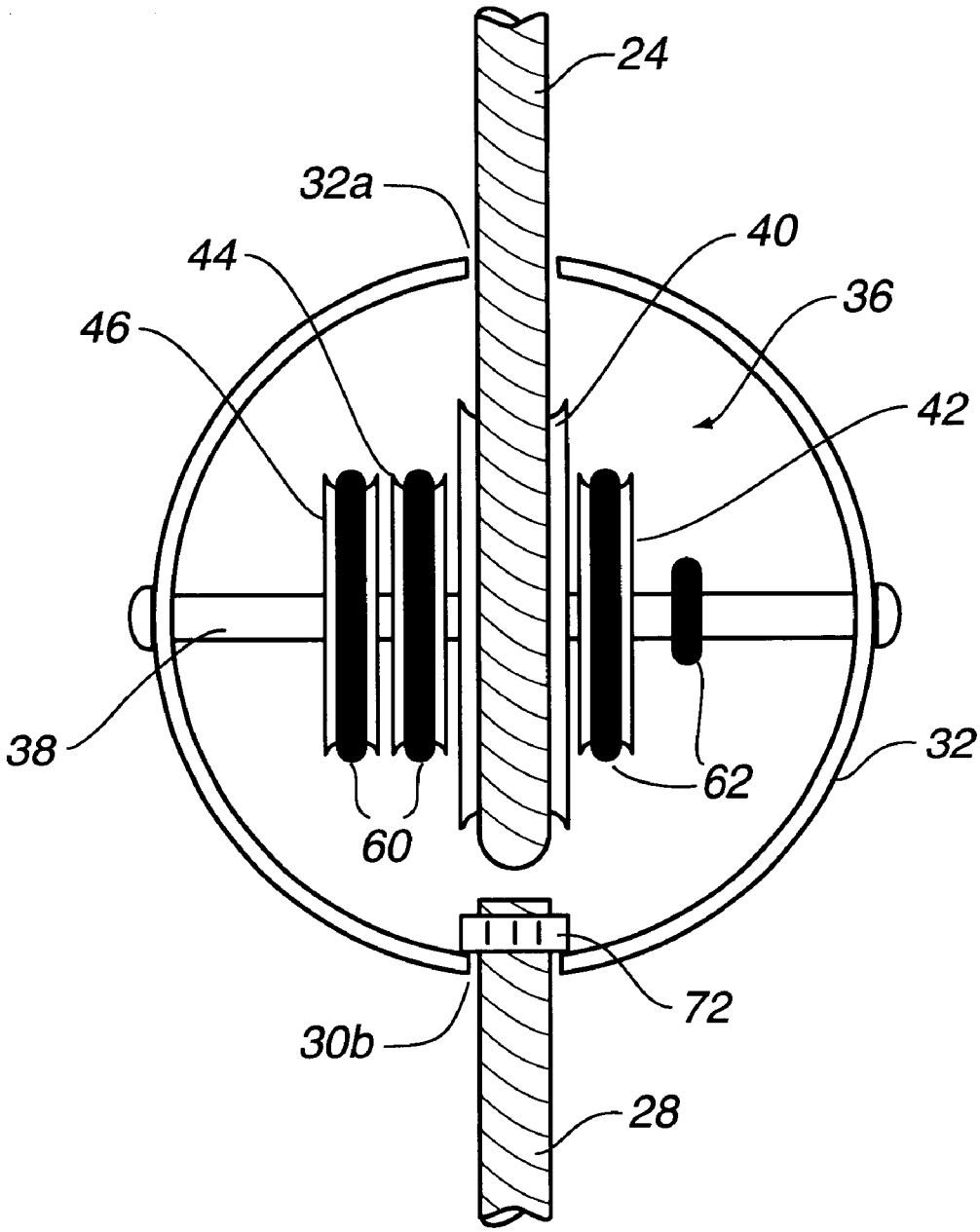
FIG. 5 is an end view in partial cross section of one of the stile retraction mechanisms contained in each tubular rung.

Referring particularly to FIGS. 3 through 6, rung assembly 14 includes the tubular rung 18, which is preferably a seamless tube of a rigid polymer such as polyvinyl chloride. Removable end caps 30 and 32 are emplaced over the ends of the rung 18. Journalled transversely within the end caps 30 and 32 are axle assemblies 34 and 36, illustrated schematically in FIGS. 4 and 6. A schematic end view of axle assembly 36 is shown in FIG. 5.

Axle assembly 36 includes an axle 38, which is mounted transversely within the endcap 32 and secured to the walls of the endcap 32 by rivets or other suitable fasteners. Journalled on the axle 38 are a rope pulley 40 and three smaller shock cord pulleys, 42, 44 and 46. The pulleys 40 through 46 are journalled for free rotation on the axle 38. Shock cord pulley 42 is located on one side of the rope pulley 40, and pulleys 44 and 46 are located on the opposite side of the rope pulley 40.

Axle assembly 34 similarly includes an axle 48, on which is journalled a rope pulley 50, and three smaller shock cord pulleys 52, 54 and 56. Shock cord pulley 52 is located on one side of the rope pulley 50, and the other two shock cord pulleys 54 and 56 are located on the opposite side of the rope pulley 50.

Figure 6:
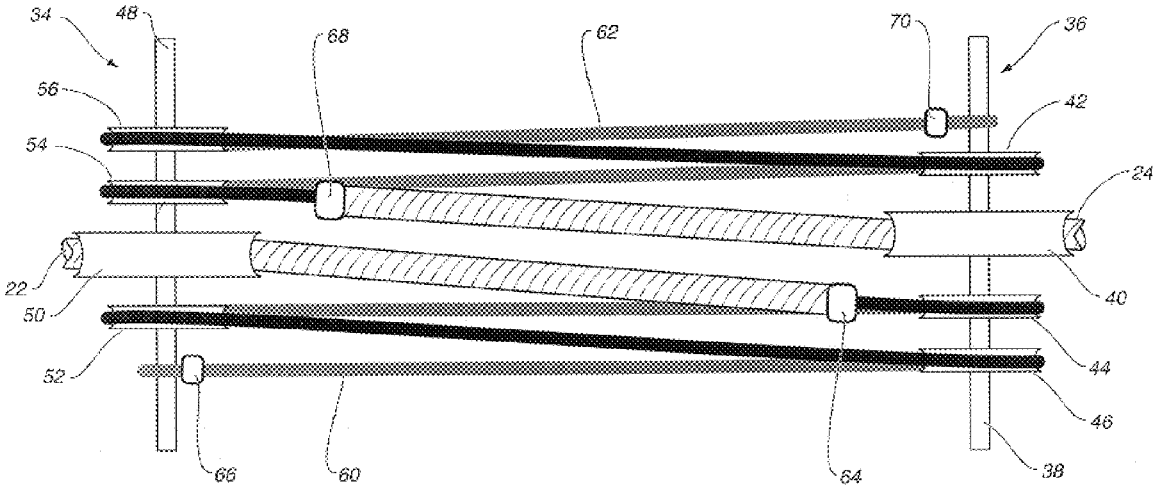
FIG. 6 is a top view of an expanded schematic illustration of the stile retraction mechanisms of FIGS. 4 and 5.

The axle assemblies 34 and 36 function, together with a pair of elastic shock cords 60 and 62, as a pair of tensioning mechanisms within the rung 18, which independently apply tension to the left and right rope stiles 22 and 24. In particular, one end of shock cord 60 is connected, inside the rung 18, to the end of left rope stile 22. In this regard, the left rope stile 22 passes downwardly through a bore 30*a* in the end cap 30 (FIG. 3), then downwardly around the rope pulley 50, where it terminates at a crimp-type connector 64, by which it is attached to one end of shock cord 60 (FIGS. 4 through 6). From that end the shock cord 60 passes around shock cord pulley 44 of axle assembly 36, thence back and around shock cord pulley 52 of axle assembly 48, thence back and around shock cord pulley 46 of axle assembly 36, and thence back to axle 48, where it is looped around axle 48 and anchored by means of a crimp-type connector 66. It will be seen that the function of shock cord 60 is to maintain constant tension on the left rope stile 22, such that it is normally withdrawn into the rung 18 to the maximum extent possible.

The crimp-type connector 64 that connects the lower end of rope stile 22 to the shock cord 60 also serves as a stop, preventing the lower end of the rope stile 22 from passing upward through the bore 30*a* of the end cap 30. Thus the connector 64 effectively limits length of rope stile 22 that passes through the bore 30*a* during extension, and thus limits the extension of rung 18 from its rest position to a length that is determined by the length of rope stile 22 normally contained in the rung 18. Ordinarily the length of the rope stile 22 contained inside the rung 18 will be selected such that, when it is fully extended to the limit set by the stop 64, the rung 18 is displaced downwardly by a distance constituting a convenient step height for a person using the ladder.

The connector 64, by functioning as a stop, also ensures that the weight of a person on the rung 18 is borne by the rope stile 22 and the connector 64, and not by the shock cord 60. This approach permits the use of relatively small shock cords that are only as strong as necessary to retract the rope stiles and raise the rung assemblies 14 and 16 to the retracted position, since the shock cords need not bear the weight of a person on the ladder. With this arrangement, the rope stile 22 can be selected and sized as appropriate to bear the weight of a person using the ladder; and the shock cord 60 can be selected and sized as necessary to only provide sufficient tensile force to retract the ladder and maintain the rung 18 positioned snugly in its upper retracted position when not in use, while readily giving way to the weight of a person when the ladder is put to use.

Similarly, the right rope stile 24 passes downwardly through a bore 32*a* in end cap 30, around the rope pulley 40, and is similarly connected at its end, inside the rung 18, to the second shock cord 62 by means of a crimp-type connector 68. The shock cord 62 passes successively around shock cord pulleys 54, 42, and 56, and terminates at axle 38, where it is tied off by a crimp-type connector 70. The connector 68 serves as a stop to prevent the end of rope stile 24 from passing through the bore 32*a,* and ensures that all weight on the rung 18 is borne by the rope stile 24 and the connector 68.

The end cap 30 includes a lower bore 30*b*. The upper end of rope stile 26 passes through the bore 30*b* and terminates at a crimp-type connector 72 (FIG. 5), which functions as a stop to prevent the end of the rope stile 26 from passing through the bore 30*b,* and by which the upper end of the rope stile 26 is thus fastened to and depends from end cap 30. Identical bores and connectors (not shown) are use to connect the upper ends of the other rope stiles to the adjacent rung assemblies.

It is further noted that, once the stiles and shock cords are installed, the removable end caps 30 and 32 are maintained in position by the tension of the shock cords, yet can be removed if necessary to service or inspect the shock cords and axle assemblies. The end caps 30 and 32 may be additionally secured in place with screws or other fasteners (not shown).

The rigid top cross member 12 has several functions. It functions to space the upper ends of rope stiles 22 and 24 by a distance approximately equal to the length of the rungs 18 and 20, thereby providing adequate clearance between the rope stiles 22 and 24 for a person using the ladder. It also functions as a stop, against which the rung 18 abuts in its fully retracted position. It also functions as a handle and as a top step to a person using the ladder. The cross member 12 may be fastened to a boat, raft or other structure by any suitable means; for example by simple extensions of the upper rope stiles 22 and 24 passing through the cross member 12. Where the rope stiles 22 and 24 pass through the cross member 12, knots or crimp-type connectors are preferably utilized to secure the cross member at the desired location on the stiles 22 and 24, and to prevent the cross member from sliding down the stiles 22 and 24 when the rung 18 is extended.

It will be recognized that in the retracted position the ladder is raised out of the water where it is unlikely to become tangled or damaged in rough conditions. At the same time, the ladder is always both readily visible and readily available to a person in the water, and simply grabbing the ladder will result in its deployment to the extended position. No assistance from anyone in the watercraft is necessary for a person in the water to deploy and use the ladder. The simplicity of deployment and use, even in emergency conditions by a person altogether unfamiliar with its construction or internal operation, renders the ladder particularly suitable for use in rough water or emergency conditions.

It will be recognized that the embodiment described above, including two substantially identical retractable rung assemblies 14 and 16, is but one of several possible variations on the present invention. In its simplest embodiment, the ladder may include only a single retractable rung assembly, with or without the rigid top cross member. In other embodiments three or more rung assemblies may be strung together in the same manner as described above.

Accordingly, the foregoing description of a preferred embodiment of the invention is presented for purposes of illustration and explanation, and is not intended to be exhaustive or to limit the invention to the precise form disclosed. Various modifications, substitutions, and alterations may be possible in view of the foregoing description. Accordingly, it is intended that the scope of the invention be defined by the following claims.

What is claimed is:

1. An extendible, self-retracting ladder comprising at least one retractable rung assembly, said retractable rung assembly including:

a tubular rung having first and second ends;

first and second retractable rope stiles each having upper and lower ends, said lower ends extending into said rung at said first and second ends of said rung, respectively, and:

first and second tensioning mechanisms mounted within said tubular rung and connected respectively to said first and second rope stiles, said tensioning mechanisms functioning to maintain sufficient tensile force on said rope stiles to retract said stiles into said tubular rung and thereby raise said rung when the ladder is not in use, while also functioning to allow the stiles to be drawn out of said rung and said rung to be extended downwardly in response to the weight of a person applied to said rung.

2. The extendible, self-retracting ladder defined in claim 1, wherein said tensioning mechanisms include:

first and second axle assemblies journalled within and transversely to said tubular rung at said first and second ends respectively, said axle assemblies each including at least one pulley around which the respective rope stile passes inwardly into said tubular rung, and:

first and second shock cords connected respectively to said lower ends of said rope stiles and anchored to said axle assemblies so as to maintain tension on said stiles.

3. The extendible, self-retracting ladder defined in claim 2 wherein each of said axle assemblies includes a plurality of shock cord pulleys, and wherein said first and second shock cords make multiple passes around said pulleys so as to extend the length of said shock cords and thereby exert relatively constant tension on said stiles independent of the extent of extension of said stiles.

4. The extendible, self-retracting ladder defined in claim 3 wherein said rung assembly includes first and second removable end caps emplaced on said first and second ends of said tubular rung, respectively, and wherein said first and second axle assemblies include axles which are affixed internally to and extend transversely with respect to said first and second end caps, respectively.

5. The extendible, self-retracting ladder defined in claim 4 wherein said first and second rope stiles pass through bores in said first and second end caps, respectively, and wherein said stiles are connected to said shock cords by connectors which are sized to not pass through said bores and which thereby function as stops, such that all weight placed on said rung is borne by said stiles and said connectors, and not by said shock cords.

6. The extendible, self-retracting ladder defined in claim 4 further including a rigid top cross member having first and second ends, said first and second rope stiles being affixed at their upper ends to said first and second ends of said cross member, and means for fastening said rigid cross member to a watercraft or other object.

7. The extendible, self-retracting ladder defined in claim 6 further comprising a plurality of said rung assemblies connected in sequence and depending from one another, and wherein the uppermost one of said rung assemblies is affixed to said rigid cross member, and where rung assemblies depending from said uppermost rung assembly are connect to one another by means of said upper ends of said stiles being affixed to the end caps of the next adjacent rung assembly.

8. The extendible, self-retracting ladder defined in claim 1 comprising a plurality of said rung assemblies connected in sequence.

9. The extendible, self-retracting ladder defined in claim 8 wherein said tensioning mechanisms include:

first and second axle assemblies journalled within and transversely to said tubular rung at said first and second ends respectively, said axle assemblies each including at least one pulley around which the respective rope stile passes inwardly into said tubular rung, and:

first and second shock cords connected respectively to said lower ends of said rope stiles and anchored to said axle assemblies so as to maintain- tension on said stiles.

10. The extendible, self-retracting ladder defined in claim 9 wherein each of said axle assemblies includes a plurality of shock cord pulleys, and wherein said first and second shock cords make multiple passes around said pulleys so as to extend the length of said shock cords and thereby exert relatively constant tension on said stiles independent of the extent of extension of said stiles.

11. The extendible, self-retracting ladder defined in claim 10 wherein said rung assembly includes first and second removable end caps emplaced on said first and second ends of said tubular rung, respectively, and wherein said first and second axle assemblies include axles which are affixed internally to and extend transversely with respect to said first and second end caps, respectively.

12. The extendible, self-retracting ladder defined in claim 11 wherein said first and second rope stiles pass through bores in said first and second end caps, respectively, and wherein said stiles are connected to said shock cords by connectors which are sized to not pass through said bores and which thereby function as stops, such that all weight placed on said rung is borne by said stiles and said connectors, and not by said shock cords.

13. The extendible, self-retracting ladder defined in claim 12 wherein there is an uppermost rung assembly among said plurality of connected rung assemblies, said upper ends of said rope stiles of said uppermost rung assembly being connected to opposite ends of a rigid cross member having means for affixing said cross member to a watercraft or other object.

* * * * *